United States Patent [19]

Remaks et al.

[11] Patent Number: 4,729,505

[45] Date of Patent: Mar. 8, 1988

[54] HEAVY-DUTY SHIPPING CONTAINER FOR FLOWABLE BULK MATERIALS

[75] Inventors: William J. Remaks, Anchorage, Ky.; John F. Nugent, Fresno, Calif.

[73] Assignee: Weyerhaeuser Company, Tacoma, Wash.

[21] Appl. No.: 930,813

[22] Filed: Nov. 13, 1986

[51] Int. Cl.[4] ..... B65D 5/35

[52] U.S. Cl. ..... 229/23 R; 229/4.5; 229/41 C; 220/441

[58] Field of Search ..... 229/23 R, 4.5, 90, 40, 229/106, 108, 109, 110, 41 C; 206/8, 600; 220/410, 408, 415, 416, 441

[56] References Cited

U.S. PATENT DOCUMENTS

| | | | |
|---|---|---|---|
| 2,620,119 | 12/1952 | George | 229/23 R |
| 2,962,159 | 11/1960 | Sheard | 229/46 |
| 3,036,752 | 5/1962 | Elliott | 229/23 R |
| 3,100,712 | 8/1963 | Meeker et al. | 99/178 |
| 3,290,205 | 12/1966 | Goldstein et al. | 161/137 |
| 3,670,946 | 6/1972 | Croley | 228/4.5 |
| 3,880,341 | 4/1975 | Bamburg et al. | 229/23 R |
| 3,937,392 | 2/1976 | Swisher | 229/41 C |
| 4,087,041 | 5/1978 | Centanni | 220/441 |
| 4,105,153 | 8/1978 | Locke | 229/23 R |
| 4,260,071 | 4/1981 | Bamburg et al. | 229/23 R |
| 4,341,337 | 7/1982 | Beach, Jr. et al. | 229/23 BT |
| 4,623,063 | 11/1986 | Balkin | 229/109 |

FOREIGN PATENT DOCUMENTS

| | | | |
|---|---|---|---|
| 703631 | 2/1965 | Canada . | |
| 0132340 | 1/1985 | European Pat. Off. . | |
| 196789 | 5/1923 | United Kingdom | 229/441 |
| 965221 | 7/1964 | United Kingdom . | |
| 1389951 | 4/1975 | United Kingdom . | |

OTHER PUBLICATIONS

Tri-Wall Product Data sheet entitled, "Double Tri--Wall King Pak".

Tri-Wall Product Case History Sheet entitled, "Double Tri-Wall King Pak Helps Reduce Costs, . . . ".

*Primary Examiner*—Willis Little

*Attorney, Agent, or Firm*—Angelo Notaro

[57] ABSTRACT

A heavy-duty shipping container for bulk flowable materials is constructed with an inner tubular sleeve of substantially circular cross section and an outer sleeve of polygonal cross section; the inner and outer sleeves are composed of multi-wall corrugated fibreboard, each designed to accommodate and support a portion of the stacking load of a like heavy-duty shipping container; the inner sleeve being supported by a support pad initially with its upper edge extended outwardly of the upper edge of the outer sleeve; and the support pad being deformable to allow the inner sleeve to displace into the outer sleeve so that both upper edges are in the same horizontal plane after the application of a predetermined pressure of the inner sleeve.

31 Claims, 13 Drawing Figures

HEAVY-DUTY SHIPPING CONTAINER FOR FLOWABLE BULK MATERIALS

BACKGROUND OF THE INVENTION

This invention relates to stackable shipping containers for flowable substances and, more particularly, to heavy-duty stackable shipping containers for the bulk transport of flowable bulk materials. As used herein the term "heavy-duty shipping container" shall mean a container for bulk materials including liquids, dry powders or granular substances, semi-solid materials such as grease, pastes or adhesives and, as well, highly viscous fluids, in volumes of at least fifty-five gallons and in weight greater than four hundred-fifty pounds.

Shipping containers used for the transport of flowable bulk materials must accommodate extraordinary weight, due to the high density of the contained materials and, at the same time, must be designed to withstand damage that can result from the nonuniform and sometimes cyclic stresses caused by the material shifting during the handling and transport of the container. Even a minor puncture or crack can cause the total loss of the flowable material. Heavy-duty shipping containers containing bulk flowable materials exceed the limits of manual handling capability and are typically mounted on pallets and handled by mechanical means such as fork lifts and handlift trucks.

Various types of containers and container materials have been designed for the transport of flowable bulk materials. Single wall (double face) corrugated fibreboard boxes, for example, have been used as inexpensive, disposable containers for light-duty applications. Such fibreboard containers, where necessary, are waxed or provided with a plastic liner bag. As the volume and weight of the contained material increases, however, the pressure of the material within the container causes bulging of the sides of the container. This makes the container difficult to stack with other similar containers. Furthermore, the bulging of the sides of the container significantly reduces the inherently limited column strength of single wall containers making this type of container unsuitable for stacking or heavy-duty application.

The term fibreboard is a general term applied to paperboard utilized in container manufacture. Paperboard refers to a wide variety of materials most commonly made from wood pulp or paper stock. Containerboard refers to the paperboard components—liner and corrugating material—from which corrugated fibreboard is manufactured. Thus, the term fibreboard, as used in the packaging industry and in the present specification and claims, is intended to refer to a structure of paperboard material composed of various combined layers of containerboard in sheet and fluted form to add rigidity to the finished product. Fibreboard is generally more rigid than other types of paperboard, allowing it to be fabricated into larger sized boxes that hold their shape and have substantial weight bearing capability.

Double or triple wall corrugated fibreboard, when made into shipping containers, provides many distinct advantages for the packaging and transport of heavy loads. Double wall corrugated fibreboard comprises two corrugated sheets interposed between three flat facing or spaced liner sheets. In triple wall corrugated fibreboard, three corrugated sheets are interposed between four spaced facing or liner sheets. Triple wall corrugated fibreboard, in particular, compares favorably with wood in rigidity and strength and, as well, in cost, and provides cushioning quality not found in wooden containers. In addition, triple wall corrugated fibreboard, relative to other fibreboard materials, advantageously provides great column strength. The column strength of triple wall corrugated fibreboard containers permits stacking, one on top of the another, of containers containing heavy loads without excessive buckling or complete collapse of the vertical walls. Triple wall corrugated fibreboard also has great resistance against tearing.

Fibreboard shipping containers employing an outer multi-sided tubular member and a simularly configured inner reinforcement to strengthen the overall container have been disclosed. See, for example, U.S. Pat. Nos. 3,159,326; 3,261,533; 3,873,017; 3,937,392; 4,013,168 and; 4,418,861.

In order to form multi-sided fibreboard tubes, it is necessary to form major score lines in the fibreboard to allow bending of the fibreboard along the edges of each panel of the container which is formed. However, scoring adversely affects the container since the lateral stability of the container significantly decreases as the number of major score lines is increased. The major scoring of the container typically permits the container, when empty, to be shipped in a knocked down, flat condition.

Circular cylindrical-shaped containers have long been regarded as the most efficient shape to use in containing liquids or dry flowable products. Paperboard designs utilizing circular cylindrical type containers, however, have been restricted to small capacity cylindrical shapes typlified by the 55 gallon capacity spiral wound fibre drum. Producing larger containers of this type has proven impractical, on a commercial basis, due to a number of reasons including excessive material and fabrication costs and the unavailability of fabricating equipment. Moreover, the fibre drums are rigid and cannot be folded into a flattened state when empty. Since existing technology requires that these fibre drums be preerected at a central location and then shipped to and stored empty in an erected or preformed condition at user locations, the utilization of cylindrical fibre drums also presents handling, shipping, and storing difficulties. Most importantly, the structural performance and handling requirements of a fibre drum, as capacity climbs to the 110 gallon to 380 gallon range, have exceeded the industry's ability to produce a readily available commercial product. Utilization of higher-strength reinforced plastic or metal drums has not provided a satisfactory alternative as such materials are typically more expensive, do not increase utilization of cubic storage space, when empty, and present a variety of disposal problems.

Thus, despite the efficiencies of circular cylindrical containment, corrugated fibreboard has not been generally used as a circular cylindrical container material. Corrugated fibreboard, particularly in the heavier grades of multi-wall fibreboard capable of containing and supporting the weights and hydrostatic pressures produced by 110 to 380 gallons of contained liquid, or an equal volume and weight of flowable solids, does not lend itself to being fabricated into circular cylindrical shapes without substantial loss of key performance features of corrugated fibreboard, that is, top to bottom compression strength and lateral stability.

SUMMARY OF THE INVENTION

The invention is directed to a stackable, heavy-duty shipping container for bulk materials comprising an inner tubular sleeve of a multi-wall corrugated fibreboard of substantially circular cross section, adapted to contain a flowable bulk material, and an outer sleeve of polygonal cross section assembled about the inner sleeve for its full length, the outer member also being constructed of a multi-wall corrugated fibreboard. Support means, preferably a deformable (impressible) bottom pad, is provided within the outer sleeve underlying the bottom edge of the inner sleeve, for initially positioning the top edge of the inner sleeve above the top edge of the outer sleeve. The support means is deformable responsive to the application of pressure to the inner sleeve which forms an impression in the support means so that the inner sleeve moves downward under a predetermined load to an equilibrium position in which the top edges of both sleeves are in the same horizontal plane.

In a preferred embodiment, the inner circumferential facing of the inner sleeve is formed with a plurality of false scores extending lengthwise, i.e. substantially parallel to the length of the inner sleeve or parallel to the flutes or corrugations thereof.

The outer sleeve is preferably constructed of triple wall corrugated fibreboard and is preferably octagonal in cross section.

The inner sleeve is a corrugated fiberboard sleeve in the form of a right circular cylinder formed of a multi-wall corrugated fibreboard such as double wall or, preferably, a triple wall corrugated fibreboard which has been subjected to a bending process to form the false scores randomly at intervals of one to six inches.

Preferably, the outer sleeve of the container is provided with bottom flaps of a single wall corrugated fibreboard construction and is provided with a removable upper end cap formed from folded corrugated fibreboard.

In one embodiment, the support means comprises a bottom pad mounted atop bottom flaps of the outer sleeve. In another embodiment, the support means comprises the bottom flaps alone.

When formed, shipping containers made in accordance with the invention are designed to contain flowable materials in volumes of at least 55 gallons and weights exceeding four hundred-fifty pounds.

Shipping containers of the invention, in comparison to steel or fibre drums presently in use, per unit of volume are less costly on a material and fabrication basis. The shipping containers of the invention provide increased utilization of cubic storage space when the containers are being shipped or stored empty in that the inventive shipping containers can be folded flat when not is use. Moreover, since the materials employed have recycle salvage value and, as well, are biodegradable, post-use disposal does not present problems associated with plastic and metallic containers.

BRIEF DESCRIPTION OF THE DRAWINGS

In the accompanying drawings, forming a part of this specification, and in which reference numerals shown in the drawings designate like or corresponding parts throughout the same.

DETAILED DESCRIPTION

Figure 1:
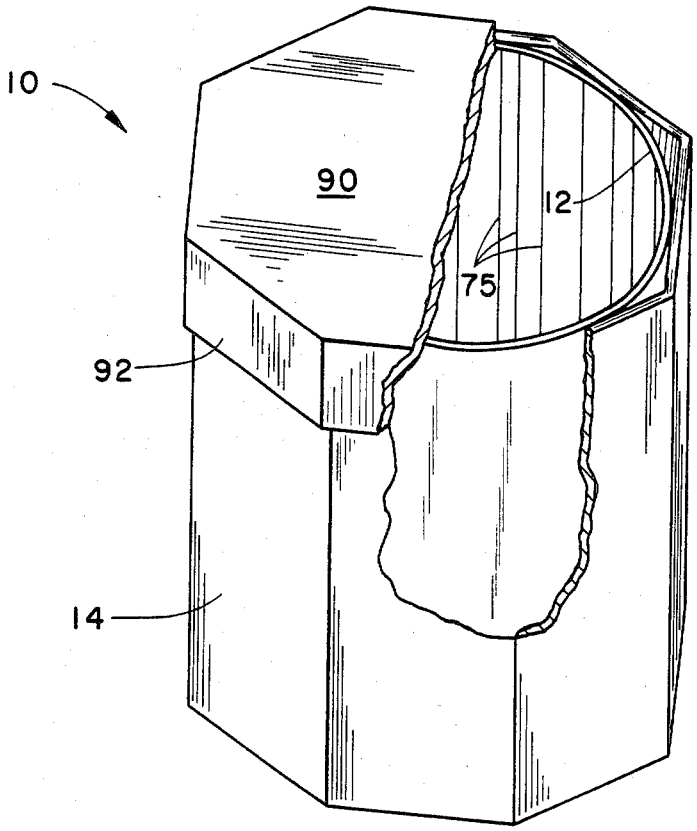
FIG. 1 is a schematic perspective view of a shipping container, partly broken away, formed in accordance with the invention.
Figure 2:
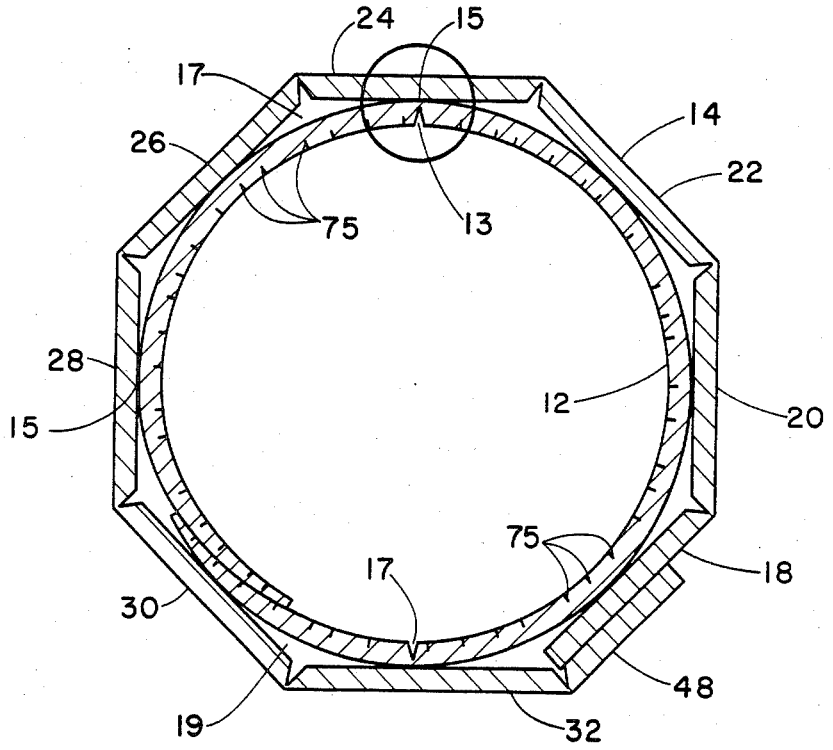
FIG. 2 is a top view of a shipping container, with the top cap removed, formed in accordance with an embodiment of the invention.
Figure 3:
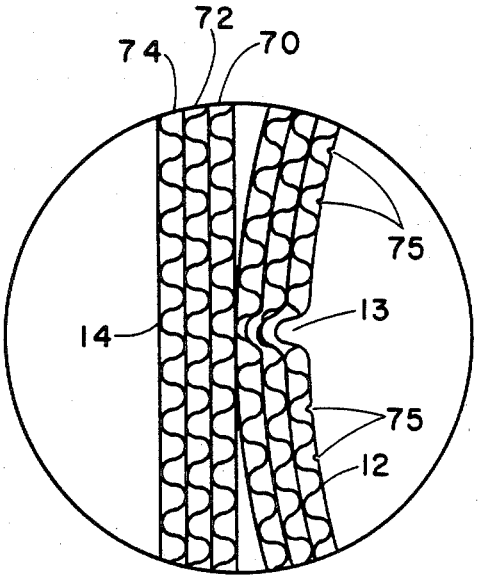
FIG. 3 is an enlarged view of the encircled detail of FIG. 2.

The shipping container 10, as disclosed herein, is constructed with a right circular inner cylindrical sleeve 12 of a multi-wall corrugated fibreboard substantially coaxially received within an outer sleeve 14 of a multi-wall corrugated fibreboard which has a polygonal cross section as best shown in FIGS. 1, 2 and 3.

Figure 4:
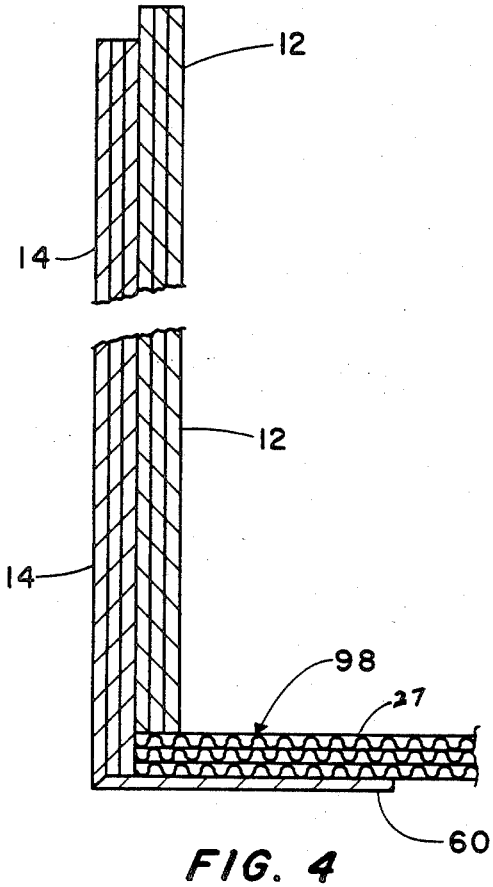
FIG. 4 is a section of a portion of the top edges of the sleeves and of a side and the bottom of the shipping container of FIG. 1.

The inner sleeve 12 is a multi-wall corrugated fibreboard which may consist of a double wall corrugated fibreboard for certain applications. In accordance with the preferred embodiments of the invention, the inner sleeve 12 is preferably composed of triple wall corrugated fibreboard as is illustrated by FIG. 4. Corrugated fibreboard, particularly heavy grades such as double and triple wall corrugated fibreboard, when used for inner sleeve construction, dramatically increases the stacking strength of the overall container as compared to a solid fibre and single wall inner sleeves.

Figure 5:
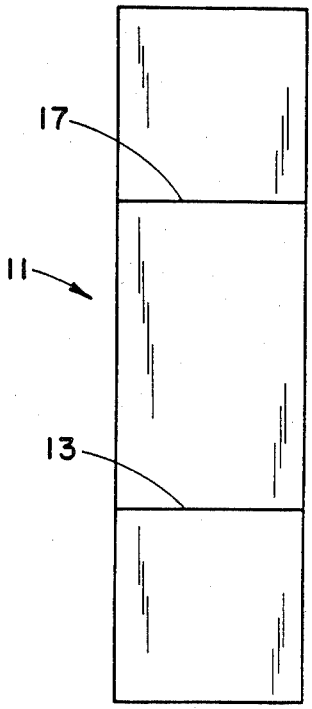
FIG. 5 is a top plan view illustrating a blank, prior to false scoring, from which an inner sleeve of the shipping container may be formed.

The inner sleeve 12, in the preferred embodiment, is formed from a flat sheet 11 of triple wall corrugated fibreboard. The flat sheet 11, as shown in FIG. 5, is formed with two major score lines 13, 17, provided preferably at diametrically opposite locations on the assembled inner sleeve 12, to allow the inner sleeve to be shipped, when empty, in a knocked down flat condition, with a uniform folded shape. The flat sheet 11 is circularly shaped in a bending apparatus, such as a sheet metal roller or a modified four bar slitter, by subjecting the corrugated sheet to a prebreaking process. The prebreaking process comprises passing the corrugated sheet through a curved path having a radius of curvature which causes the random formation of multiple scores 75, so-called false scores, running in the direction of the corrugations, on the smaller radius of the curved sheet. The randomly spaced false scores 75, which in the case of the triple wall corrugated fibreboard occur variously, approximately from one to six inches apart, help facilitate the formation of a nearly perfect cylindrical shape of the inner sleeve 12, when the inner sleeve is placed within the outer polygonal sleeve, and filled with a liquid or flowable solid substance. Besides providing these random scores, the prebreaking process also stretches the outer facing of the corrugated fibreboard sheet, and compresses the inner facing to the extent that when assembled into a sleeve, and secured by a glue joint, the sleeve, although it can be folded flat, maintains a circular cylindrical shape when erected. The end portions of the sheet, which comprises the circular inner sleeve, are overlapped and adhesively combined in a lap joint. The outer circumferential facing of the inner sleeve is not substantially creased or scored but remains substantially smooth.

The randomly-spaced false scores 75 of the corrugated fibreboard sheet, when assembled into a sleeve configuration, extend generally parallel to the longitudinal axis of inner sleeve 12. As used herein, it should be understood that the terminology "false scores" does not comprise score lines of the type which are formed with a scoring tool but are the type of scores known in the fibreboard industry as "false scores" which result from the application of prebreaking stress to sheetstock materials. As best shown in the enlarged detail view provided in FIG. 3, the false scores only crease the innermost (on the small diameter side of the sleeve) facing of the inner sleeve 12 of triple wall fibreboard. In comparison, the mechanical scores 13, 17 formed to allow folding of the inner sleeve blank crease the innermost facing and, as well, the intermediate facings and flutes of the triple wall fibreboard comprising the inner sleeve 12. It is critical that the described false scores be used to obtain the circular configuration of the inner sleeve as, for example, use of a multiplicity of numerous mechanical score lines would debilitate the strength of the inner sleeve.

Figure 6:
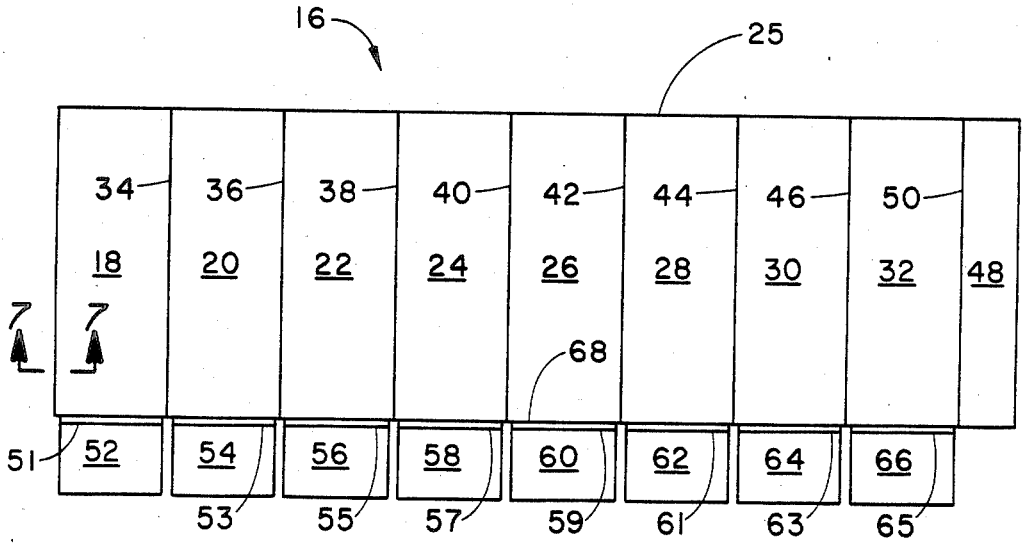
FIG. 6 is a top plan view of a blank from which an outer sleeve of the shipping containers may be formed.
Figure 7:
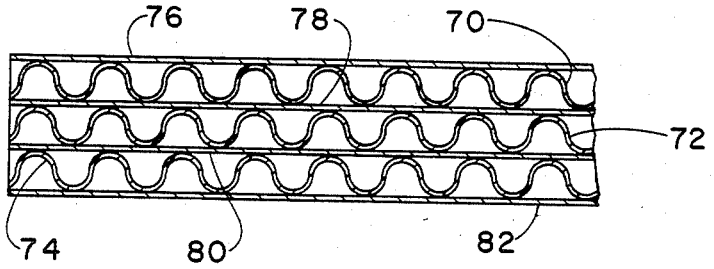
FIG. 7 is a sectional view taken along line 7—7 of FIG. 6.
Figure 8:
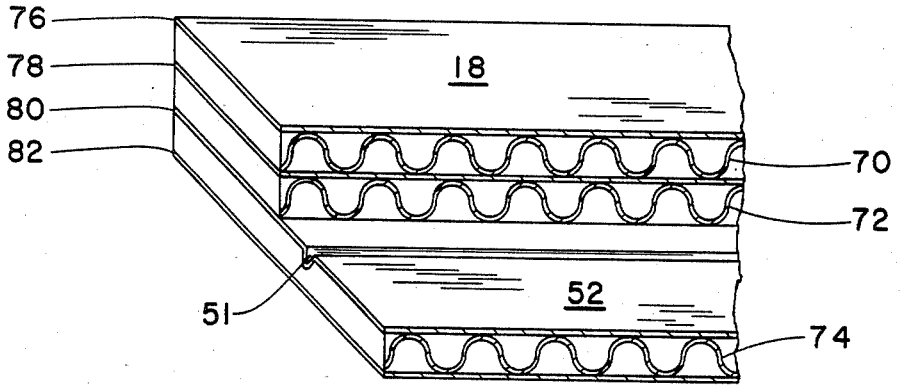
FIG. 8 a perspective view showing on end flaps of and outer sleeve of the shipping containers.

Outer sleeve 14, in accordance with a preferred embodiment of the invention, comprises a tubular member having an octagonal cross section. The outer sleeve 14 is formed from a substantially rectangular sheet 16 of corrugated fibreboard, shown in FIG. 6. The rectangular sheet 16 is die cut and scored for folding, by techniques well understood in the art, and includes a plurality of substantially rectangular sidewall panels 18, 20, 22, 24, 26, 28, 30 and 32, foldably connected to each other along lateral score lines 34, 36, 38, 40, 42, 44, 46 and a sealing flange 48 foldably connected to wall panel 32 via a lateral score line 50. Bottom flaps 52, 54, 56, 58, 60, 62, 64, 66 are formed at one of the opposite edges of the respective wall panels and are foldable along score lines 51, 53, 55, 57, 59, 61, 63, 65 which are formed on the bottom flap approximately one-eight inch from the bottom edge 68 of the wall panels. The wall panels are preferably formed from triple wall corrugated fibreboard which, as shown in FIG. 7, include three corrugated sheets 70, 72, 74. The ridges of the corrugated sheets are adhesively secured to liner sheets 76, 78, 80 and 82. The bottom flaps are preferably formed of single wall corrugated fibreboard, as shown in FIG. 8. which is integral to the triple wall side wall panels. The end panels may be formed on a triple wall combiner machine as part of the combiner process in a manner well-known to those skilled in the corrugated fibreboard container industry.

The rectangular sheet 16 is bent along the lateral fold lines into the form of an octagon, when viewed in cross section. The sealing flange 48 overlaps the exposed face of liner 76 and is adhesively secured thereto, in a known manner, to form outer sleeve 14. The bottom flaps are then sequentially folded inwardly of the outer sleeve 14 so that adjacent flaps overlie each other. The use of bottom flaps on the outer sleeve adds to the structural integrity of the container. The bottom flaps can be omitted and a lower end cap, similar to the upper end cap, employed with less favorable results. Alternatively, both a bottom end cap and bottom end flaps can be utilized. The inner sleeve does not have end flaps, i.e. is flapless.

A bottom pad 98 is preferably inserted into the outer sleeve 14 and rests upon the infolded end flaps 52, 54, 56, 58, 60, 62, 64. The bottom pad 98, in the illustrated embodiment, has an octagonal-shaped cross section and is designed to be closely received within the outer sleeve 14. The peripheral edges of the bottom pad 98 bear against the side walls of the outer sleeve 14. The bottom pad 98 is preferably composed of triple wall corrugated fibreboard.

The inner sleeve 12 is then inserted into the outer sleeve 14. The outer sleeve 14 is sized such that the wall of the inner sleeve 12 touches at approximately the mid-point of each of the walls of the outer sleeve 14 as typically shown at 15. Gaps 19 are formed between the inner sleeve 12 and the corners of the outer sleeve 14, the corners being defined by the lateral score lines between the wall panels of the outer sleeve 14.

The bottom end of the inner sleeve 12 is mounted upon the bottom pad 98. Inner sleeve 12 is dimensioned so that the upper edge 21 of the inner sleeve 12 is initially slightly higher than the upper edge 25 of the outer sleeve 14 by a distance less than the thickness of the bottom pad 98 as shown in FIG. 4. The bottom pad 98, as well as the bottom flaps, are composed of a suitably deformable material so that the pad 98 will deform responsive to the application of pressure to the inner sleeve 12 to form an impression coinciding with the outline of the bottom edge 23 of the inner sleeve 12. Consequently, in the post-loaded condition, the inner sleeve moves downwardly relative to the outer sleeve from the initial pre-loaded position. The initial height of the upper edge 21 of the inner sleeve 12 above the upper edge 25 of the outer sleeve 14, is predetermined so that in the postloaded condition the upper end of each of the inner and outer sleeve is in the same horizontal plane. Thus, both the inner and outer sleeve will accommodate and support the weight of containers which may be stacked thereon.

Figure 11:
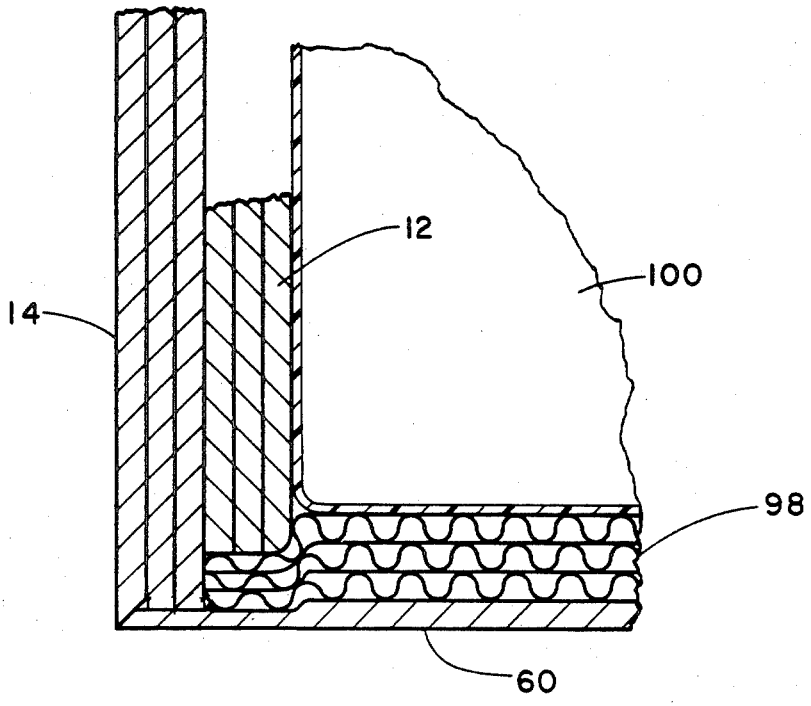
FIG. 11 is a section of a portion of the side and bottom of the container, similar to FIG. 4, after the inner sleeve has been loaded and has reached the equilibrium position.
Figure 13:
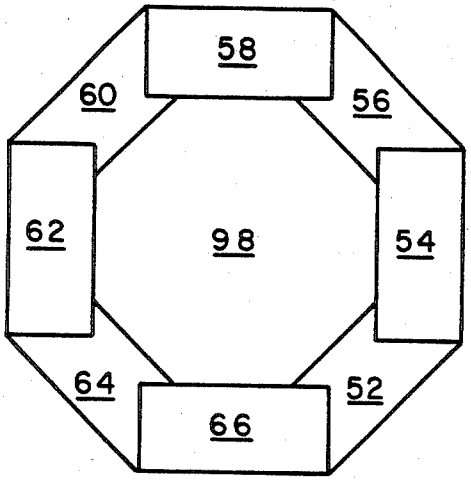
FIG. 13 is a bottom view of the container of FIG. 1.
Figure 12:
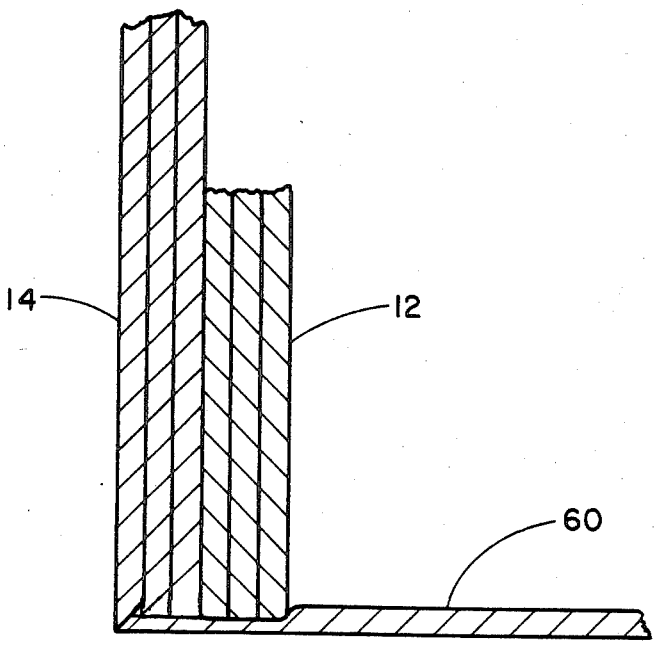
FIG. 12 is a section, similar to FIG. 11, in which the bottom pad has been omitted.

In the post-loaded condition, the lower edge 23 of the inner sleeve 12 extends below the inner face 27 of the central portion of the bottom pad 98 and bottom flaps as shown in FIG. 11. This feature is particularly advantageous insofar as it minimizes the possibility of damage to an enclosed flexible bag could slip under the bottom edge 23 should the inner sleeve 12 be vertically upset in transit. In an absence of the bottom pad, as shown in FIG. 12, the inner sleeve 12 will form an impression in the bottom flaps.

If the inner sleeve is not initially positioned higher than the outer sleeve, but initially arranged at the same height, the application of pressure to the inner sleeve, due to bulk loading or stacking of a similar container atop the container, or both, will nevertheless cause the inner sleeve to depress or crush the bottom pad and inner sleeve will displace downwardly into the bottom pad. As a result, all of the stacking load will necessarily, and undesirably, then be borne by the outer sleeve thereby deflating the advantages of utilizing an inner sleeve capable of accommodating significant stacking loads.

In operation, a plastic retainer, normally a flexible plasticbag, will be inserted into the inner sleeve to contain the flowable bulk materials. It has been found that filling of the bag with the bulk materials, in itself, will result in some depression of the bottom pad and the resultant downward movement of the inner sleeve. However, the initial distance of the upper edge of the inner sleeve above the upper edge of the outer sleeve is predetermined so that the post-loaded equilibrium position, in which both of the upper edges are in the same horizontal plane, is preferably not reached until a load, having a weight of at least four hundred and fifty pounds is placed atop the inner and outer sleeve, for example, by stacking a similarly loaded container thereon. It should be noted that the degree to which the bottom pad 98 and the bottom flaps 52–66 depress when a load is placed on top of the inner sleeve 12 will vary to a small degree based on the paper weights and flute configuration of the corrugated containerboard being utilized, but those skilled in the art of paperboard container manufacture should have no difficulty making those adjustments necesary to achieve optimal performance of this container.

Although the outer sleeve 14 is shown as octagonal in cross section, it will be appreciated that any polygonal cross section may be utilized.

The container 10 is preferably closed at its top by a removable end cap 90, which has a cross section similar to that of the outer sleeve and, thus, in the illustrated embodiment has an octagonal configuration. End cap 90 has downwardly extending peripherial side flanges 92 which extend outside and are engageable with the ends of the outer sleeve below the upper edge of the outer sleeve 14. The end cap 90 is preferably may be formed from single wall corrugated fibreboard. The end cap 90 distributes the stacking loads to the inner and outer sleeves.

Figure 9:
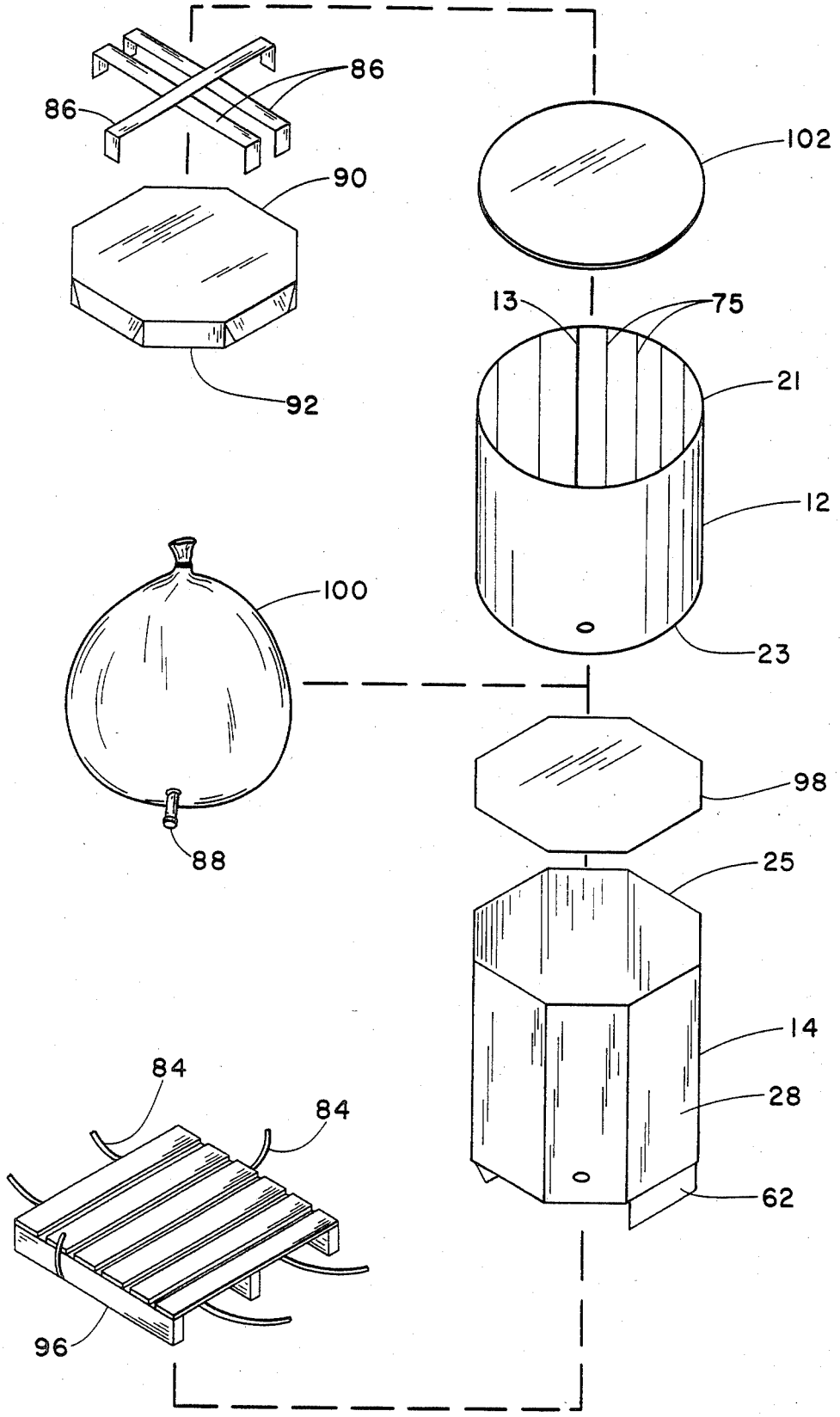
FIG. 9 is an exploded schematic view, in perspective, illustrating a shipping assembly embodying the invention.
Figure 10:
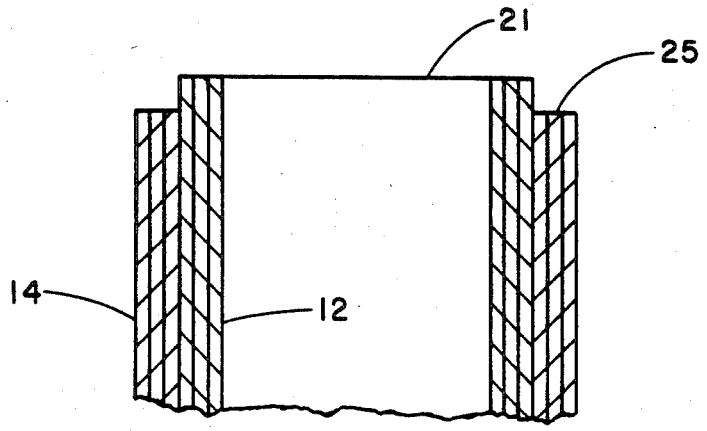
FIG. 10 is a partial sectional view which illustrates the relative heights of the top edges of the assembled inner and outer sleeves in the pre-loaded initial position.

FIG. 9 illustrates a shipping assembly in accordance with the invention. A separate pallet 96 of conventional construction is employed beneath the shipping container to facilitate movement of the containers by a fork lift or hand lift truck.

A plastic liner bag 100 is preferably provided within the inner sleeve 12 to leak-proof the container. The liner bag 100 precludes the flow of the contained materials between the interstices that may exist in between the end flaps and at the bottom pad. A suitable liner bag 100 can be made from a flexible plastic film material, such as polyethylene extruded film or the like.

The bottom flaps do not extend across the entire bottom of the container as shown in FIG. 12. The bottom pad 98, therefore, protects the plastic liner bag 100 from abrasive contact with the pallet as well as potential nail head or splinters protruding from the pallet, and assists in the retention of the bag within the inner sleeve.

In certain applications, a compressible top pad 102 with a circular cross section is provided as a filler to fill any head space or void area that may exist or occur, for example, due to incomplete filling, settling, or contraction of the contained material, between the liner bag 100 and the end cap 90. The top pad 102 is particularly suited for applications in which a liquid is contained as it prevents, or at least helps to reduce, the harmful sloshing or surging of the liquid which tends to occur during transit motion. However, the compressibility of the top pad 102 still allows expansion of the liquid, thereby releasing some of the hydrostatic or hydraulic pressures which would otherwise be exerted against the sidewalls and bottom of the container. The top pad 102 is preferably composed of triple wall corrugated fibreboard or polyether foam. The periphery of the top pad bears against the inner surface of the inner sleeve 12.

Steel strapping 84 is employed to hold the shipping containers to the pallet 96. In order to avoid damage to the end cap 90, inverted U-shaped steel strapping braces 86 are mounted across the end cap 90 intermediate of both the upper surface and side flanges 92 of the end cap and the strapping 84. Each strapping brace 86 consists of a flattened central elongated plate and depending legs designed to overlie the top surface and flanges 92, respectively, of the end cap. The braces 86 are provided with a greater width than the strapping 84 in order to more evenly distribute the strap forces over the shipping container. The surface of the strapping brace 86 is preferably beaded in order to inhibit slippage between the strapping and the brace. When the strapping braces 86 are tightened down by the strapping 84, the inner sleeve 12 is positively seated against the bottom pad 98 to further stabilize the contained load. The end flaps are held in place by the weight of the contained materials pressing down on the bottom pad and, in conjuction with the pressure of the strapping, provide a strengthening or resistance to lateral deflection at the bottom of the outer sleeve 14, which is the area that is most vulnerable to buckling or deflection. The strapping forces are generally not of sufficient magnitude to cause the inner sleeve to displace and crush into the bottom pad to the equilibrium position.

A bottom spout fitment 88, as is known in the bag industry, may be provided. The fitment 88 extends through cutouts formed in the outer sleeve and the inner sleeve. The fitment 88 is connected to the liner bag to allow gravity evacuation of the material contained within the liner bag 100. The fitment extends through apertures formed through the walls of the inner and outer sleeves.

Actual containers, built in accordance with the invention, have been subjected to drop tests, vibration tests and high humidity compression tests with markedly successful test results. The following examples are illustrative and explanatory of portion of the invention.

EXAMPLE I

A shipping container was constructed according to the invention. The outer sleeve was formed of a triple wall 1500 AAA grade corrugated fibreboard. The outer sleeve had an octagonal cross section and was approximately 40 inches across and 44 inches high. The inner sleeve was also formed from triple wall 1500 (Beach puncture test rating) AAA grade corrugated fibreboard material bent into a circular cylindrical shape with random scores. Single wall bottom end flaps were employed. An octagonal-shaped bottom pad formed from 0900 AAA grade corrugated fibreboard and a top end cap of 275# single wall, fluted fibreboard was utilized to close the ends of the outer sleeve. A plastic liner bag, filled with 220 gallons of water, was inserted into the container. A top pad composed of a triple wall 0900 AAA grade corrugated fibreboard having an octagonal shape was placed on top of the liner bag to substantially fill the void between the liner bag and the top end cap. Three $\frac{3}{4}$-inch$\times$0.020 inch size steel strappings were used to attach the container to a 2-way entry wooden pallet 44×44 inches. Two straps were placed in the same direction and one strap was placed crosswise over the other two. Each strap was mounted on a five inch wide brace of 16 gauge beaded sheet metal with three-inch long legs.

The container was tested using a distribution cycle patterned after ASTM standard D-4169, distribution cycle no. 11 rail, trailer on flat car to simulate handling, vertical linear motion, loose-load-rotary motion vibration and rail switching. The liquid was retained within the liner bag without leakage throughout the entire test procedure.

(A)

Handling Drop Test

In the drop test, the container was raised six inches off of a concrete floor by means of a fork lift and dropped on edge. The test was repeated on the opposite edge. No leakage occurred.

(B)

Vertical Linear Motion Vibration Tests

The container was subjected to vertical linear motion vibration by placing it on the table of a vertical linear motion vibration tester having a table displacement of 1.0 inch. The low and medium vibration emported in vertical linear vibration testing simulates truck transit conditions and determines whether destructive resonance of the container will occur. The container was horizontally restrained. The container was placed on the table and subjected to 260 cpm for 40 minutes. The container was then placed on an a higher vibration machine, again restrained in the horizontal direction, and subjected to 40 minutes of vertical linear vibration at the following frequencies and displacements:

| Test (minutes) | Frequency (hertz) | Displacement (inches) |
|---|---|---|
| 10 | 13 | 0.12 |
| 10 | 21.8 | 0.07 |
| 10 | 33.3 | 0.05 |
| 10 | 36.3 | 0.02 |

No leakage occured throughout the vertical linear motion vibration testing.

(C)

Loose Load-Rotary Motion Vibration Test

The container was also placed on a rotary motion vibration machine with a table displacement of 1.0 inch. The rotary vibration test simulates the side-to-side motion which commonly occurs in rail transport or piggy back shipments. The container was vibrated for twenty minutes at a frequency of 235 rpm. It was then rotated ninety degrees and vibrated for another twenty minutes at 235 rpm. No leakage occurred.

(D)

Rail Switching-Incline Impact Test

The container was placed on the dolly of an incline-impact machine for impact against a bulkhead to simulate train car bumping. A second container (also filled) was placed behind the first container. The container was subjected to one impact of 4 mph and two impacts of 6 mph. No leakage occured.

EXAMPLE II

A shipping container was constructed according to the invention (as set forth in Example I) for testing after being subjected to adverse humidity conditions. A plastic liner bag was filled with 220 gallons of water and inserted into the container.

The container was conditioned for 72 hours at 90° F. and a relative humidity of 90%. After 72 hours the conditioned container was compression tested to simulate container stacking. A load was applied by a top platen travelling downwardly at a speed of 0.5 inch per minute until the container failed. Failure did not occur until a load of 8,600 pounds was reached.

EXAMPLE III

A container constructed as in Example I was conditioned for 72 hours at 73° F. and a relative humidity of 50%. A plastic liner bag was filled with 220 gallons of water and inserted into the container. A load was applied as set forth in Example II. Failure of the container did not occur until a load of 18,000 pounds was reached.

It is a particular feature of the container according to the invention that the inner sleeve 12 may be filled with a bulk flowable material without bulging. This is due to the circular cross section of the inner sleeve 12, which transmits the pressure from the flowable load, purely into hoop stress in the walls of the inner sleeve 12, inherently resisting any bulging of those walls.

The criticality of the initially assembled, relative heights of the circular inner and polygonal outer sleeves is demonstrated by the following example.

EXAMPLE IV

An inner cirular sleeve was assembled within an octogonal outer sleeve. The height of the inner circular sleeve was equal to the height of the octagonal outer sleeve when assembled. It was observed, after strapping and stacking these containers for approximately one week, that the top edge of the outer sleeve compressed ⅛" or more, until a part of the load weight rested upon the inner sleeve and when load was transferred to the inner sleeve, it deformed the bottom pad until the top edge of the outer sleeve ceased to compress and the inner sleeve ceased bearing weight.

Accordingly, in accordance with the invention, the upper edge of the inner sleeve projects above the top edge of the outer sleeve so that when strapped and stacked, the inner sleeve will deform and compress the bottom pad and flaps to the maximum amount possible, reaching a height equilibrium of the inner and outer sleeves. Both the inner and outer sleeves then bear weight and allow the containers to be stacked with less danger of collapsing.

Testing, as shown in Example V, has demonstrated the relative deformation of a triple wall corrugated fibreboard bottom pad and single wall flaps.

EXAMPLE V

Three containers, each having different capacities, were filled and used as the bottom containers in a three-high stack test for a period of three weeks. Each of the different capacity containers were made so that the inner sleeve projected above the top edge of the outer sleeve by 5/16", 7/16" and 9/16". The results of the test showed that a container with an inner sleeve height 5/16" over the top edge of the outer sleeve achieved equilibrium when the bottom pad and flaps deformed the maximum amount. Using this test data, it was determined that the inner sleeve height is initially higher than the outer sleeve in the assembled condition by 0.3125 inches but is less than the outer sleeve unassembled height by 0.625 inches.

An example of this relationship is shown in a size analysis of a 220 gallon container (all diminsions are in inches):

| | |
|---|---|
| Outer sleeve inside unassembled height | 44.0000 |
| Caliper of bottom pad | 0.5625 |
| Caliper of flap × 2 (.1875 × 2) | 0.3750 |
| Height of inner sleeve | 43.3750 |
| Initial projection of inner over outer sleeve | .3125 |
| Height of unassembled outer sleeve | 44.0000 |
| Height of inner sleeve | 43.3750 |
| Relationship of inner to outer height | .6250 |

The outer sleeve 14, due to its construction from a double wall or triple wall corrugated fibreboard, is adapted to resist endwise crushing loads, permitting a number of such fully loaded containers to be stacked one upon the other.

The enhanced capability of the heavy-duty shipping container to accommodate and withstand static and cyclic loads is attributable to a structure which utilizes a circular multi-wall fibreboard inner sleeve and an outer multi-wall fibreboard container against which the inner sleeve bears and in which both the circular and polygonal sleeves support part of the stacking load. Constructions utilizing solid fibre or single wall (double face) corrugated fibreboard inner or outer sleeves are not suited to use as heavy-duty shipping containers and are outside of the scope of the invention.

The term "heavy duty" is used herein to define containers designed to accommodate bulk flowable materials in volumes of at least 55 gallons and weights of 450 pounds and greater. The term "stackable" as used herein refers to heavy-duty containers capable of supporting like containers containing heavy-duty bulk flowable materials of equal volume and weights without bulging or failure of the lowermost container.

The shipping container design described herein, when utilized in conjunction with a plastic liner bag, is suitable for liquids and dry, flowable products in volumes of 55 gallons up to 380 gallons, liquid measure. Liquids and suspensions which weigh as much as 12.5 lbs. per gallon and flowable dry solids which weigh as much as 115 lbs. per cubic foot can be effectively contained in fibreboard containers of this design in those volumes.

The invention claimed is:

1. A heavy-duty shipping container for flowable bulk materials comprising:

an outer sleeve vertically extending between a bottom edge and a top edge, said outer sleeve having a polygonal cross-section and comprising a plurality of sidewall panels;

an inner sleeve, substantially coaxially mounted in the outer sleeve, and vertically extending between a bottom edge and a top edge, said inner sleeve having a substantially circular cross section;

the inner sleeve bearing centrally along each of the sidewall panels;

the inner sleeve and outer sleeve each comprising a multi-wall corrugated fibreboard; and support means, mounted within the outer sleeve and underlying the bottom edge of the inner sleeve, for positioning the top edge of the inner sleeve initially higher than the top edge of the outer sleeve, said support means being deformable responsive to pressure applied to the inner sleeve so that the inner sleeve moves downwardly to a post-loading position in which the top edges of the inner and outer sleeves are in the same horizontal plane, whereby each of the inner and outer sleeves can accommodate a portion of the load of a similar container stacked thereon.

2. A heavy-duty shipping container according to claim 1, wherein the support means comprises a bottom pad having a polygonal cross section complimentary to the cross section of the outer sleeve, said bottom pad having peripheral edges being of such size as to be continguous to the sidewall panels.

3. A heavy-duty shipping container according to claim 2, wherein the bottom pad comprises corrugated fibreboard.

4. A heavy-duty shipping container according to claim 2, wherein the bottom pad comprises triple wall corrugated fibreboard.

5. A heavy-duty shipping container according to claim 2, wherein the inner sleeve is flapless.

6. A heavy-duty shipping container according to claim 1, further comprising a bottom flap attached to each of the sidewall panels along a foldline along the bottom edge of the outer sleeve, the bottom flap underlying the support means.

7. A heavy-duty shipping container according to claim 2, wherein in the initial position the top edge of the inner sleeve extends higher than the top edge of the outer sleeve for a distance not exceeding the thickness of the bottom pad.

8. A heavy-duty shipping container according to claim 2, further comprising a bottom flap attached to each of the sidewall panels along a foldline along the bottom edge of the outer sleeve, the bottom flap underlying the support means.

9. A heavy-duty shipping container according to claim 8, wherein the inner sleeve is flapless.

10. A heavy-duty shipping container according to claim 6, wherein the bottom flap comprises single wall corrugated fibreboard.

11. A heavy-duty shipping container according to claim 3, in which each of the inner and outer sleeves comprises corrugated fibreboard having flutings which extend vertically and the bottom pad comprises flutings which extend normal relative to the flutings of the inner and outer sleeves.

12. A heavy-duty shipping container according to claim 2, wherein in the post-loaded position the bottom pad includes a central position and peripheral position which is vertically depressed relative to the central portion, the bottom edge on the inner sleeve being mounted on the peripheral portion intermediate the central portion and the sidewalls of the outer sleeve.

13. A heavy-duty shipping container according to claim 1, wherein the support means comprises bottom flaps connected along fold lines to the sidewall panels.

14. A heavy-duty shipping container for flowable bulk materials comprising:

an outer sleeve vertically extending between a bottom edge and a top edge, said outer sleeve having a polygonal cross-section and comprising a plurality of sidewall panels;

an inner sleeve, substantially coaxially mounted in the outer sleeve, and vertically extending between a bottom edge and a top edge, said inner sleeve having a substantially circular cross section;

the inner sleeve bearing centrally along each of the side wall panels;

the inner sleeve and outer sleeve each comprising a multi-wall corrugated fibreboard;

support means, mounted within the outer sleeve and underlying the bottom edge of the inner sleeve, for positioning the top edge of the inner sleeve initially higher than the top edge of the outer sleeve, said support means being deformable responsive to pressure applied to the inner sleeve so that the inner sleeve moves downwardly to a post-loading position in which the top edges of the inner and outer sleeves are in the same horizontal plane, whereby each of the inner and outer sleeves can accommodate a portion of the load of a similar container stacked atop the said container; and the inner sleeve having an inner circumferential facing with a multiplicity of false scores extending verticially along the sleeve.

15. A heavy-duty shipping container according to claim 14, wherein the inner sleeve comprises a triple wall corrugated fibreboard.

16. A heavy-duty shipping container according to claim 14, wherein the circular inner sleeve comprises a sheet of triple wall corrugated fibreboard formed by the steps of passing the sheet through a curved path so as to impart a curvature to the corrugated sheet to cause the randomly spaced formation of multiple false scores on the inner circumferential facing of the inner sleeve in the direction of the corrugations, overlapping edges of the sheet, and adhesively securing the overlapped edges to each other.

17. A heavy-duty shipping container according to claim 14, wherein the outer sleeve has an octagonal cross section.

18. A heavy-duty shipping container according to claim 14, wherein the outer sleeve comprises triple wall corrugated fibreboard and the inner sleeve comprises triple wall corrugated fibreboard.

19. A heavy-dury shipping container according to claim 18, wherein the outer sleeve has a octagonal cross section.

20. A heavy-duty shipping container according to claim 19, wherein the inner sleeve is formed by the steps of passing the sheet through a curved path so as to impart a curvature to the corrugated sheet to cause the randomly spaced formation of multiple false scores on the inner circumferential facing of the inner sleeve in the direction of the corrugations, overlapping edges of the sheet, and adhesively securing the overlapped edges to each other.

21. A heavy-duty shipping container according to claim 20, wherein the false scores of the inner sleeve are spaced from one to six inches apart.

22. A heavy-duty shipping container according to claim 21, further comprising a plurality of bottom flaps, each end flap being foldably connected to a respective one of the side walls at the bottom edge of the outer sleeve, each of the bottom flaps comprising a single wall corrugated fibreboard, and each of the end flaps being folded inwardly of the outer sleeve beneath the support means.

23. A heavy-duty shipping container according to claim 22, further comprising a bottom pad, the bottom pad having a octagonal cross section, and the bottom pad being mounted on the bottom flaps intermediate the bottom flaps and the inner sleeve.

24. A heavy-duty shipping container according to claim 23, wherein the bottom pad has a peripheral edge mounted against the wall panels of the outer sleeve.

25. A heavy-duty shipping container according to claim 24, wherein the bottom pad comprises triple wall corrugated fibreboard.

26. A heavy-duty shipping container according to claim 25, further comprising bag means for containing the flowable materials mounted within and substantially filling the inner sleeve.

27. A heavy-duty shipping container according to claim 26, further comprising a top pad, and an end cap mounted on the top edges of the outer sleeve and inner sleeve, the top pad having a circular cross section, the top pad being mounted within the inner sleeve intermediate the bag means and the end cap, and wherein the top pad has a circular periphery in engagement with the inner sleeve.

28. A heavy-duty shipping container according to claim 27, wherein the top pad comprises a triple wall corrugated fibreboard panel.

29. A heavy-duty shipping container according to claim 27, wherein the top pad comprises a compressible polyether foam panel.

30. A heavy-duty shipping container according to claim 27, wherein the end cap has a cross section similar to the cross section of the outer sleeve, the end cap having peripheral side flanges which overlie the side wall of the outer sleeve and further comprising a plurality of inverted U-shaped braces mounted to the end cap, each brace including a central portion overlying the end cap intermediate the flanges of the end cap and depending legs overlying opposite flanges of the end cap, a pallet, and strap means overlying the braces for holding the container to the pallet.

31. A heavy-duty shipping container according to claim 1 or 2 or 4 or 14 or 15 further comprising bag means for containing flowable materials within and substantially filling the inner sleeve.

* * * * *

UNITED STATES PATENT AND TRADEMARK OFFICE

CERTIFICATE OF CORRECTION

PATENT NO. : 4,729,505

DATED : March 8,1988

INVENTOR(S) : William J. Remaks
John F. Nugent

It is certified that error appears in the above-identified patent and that said Letters Patent is hereby corrected as shown below:

On the cover page, left column, between item "[22]" and "[51]", insert -- [63] Continuation-in-part of Ser. No. 807,974, Dec. 12, 1985, abandoned. --

Column 1, between lines 2 and 3, add the following paragraph: -- This application is a continuation-in-part of application, Serial No. 807,974, filed December 12, 1985, and now abandoned. --

In claim 12, line 2 (column 12, line 52), change "post-loaded" to -- post-loading --.

Claim 12, line 7 (column 12, line 57), change "sidewalls" to -- sidewall panels --.

Claim 22, lines 3 and 6 (column 14, lines 6 and 9), change "end" to -- bottom -- (both occurrences).

Claim 22, line 4 (column 14, line 7), change "side walls" to -- sidewall panels --.

Claim 23, line 3 (column 14, line 14), change "a" to -- an --.

UNITED STATES PATENT AND TRADEMARK OFFICE

CERTIFICATE OF CORRECTION

PATENT NO. : 4,729,505

DATED : March 8, 1988

INVENTOR(S) : William J. Remaks, John F. Nugent

It is certified that error appears in the above-identified patent and that said Letters Patent is hereby corrected as shown below:

Claim 24, line 3 (column 14, line 19), change "wall" to -- sidewall --.

Signed and Sealed this

Twenty-third Day of August, 1988

*Attest:*

DONALD J. QUIGG

*Attesting Officer*

*Commissioner of Patents and Trademarks*